US008403034B2

(12) United States Patent
Askeland et al.

(10) Patent No.: US 8,403,034 B2
(45) Date of Patent: Mar. 26, 2013

(54) DEVICE AND METHOD FOR MAINTAINING CONSTANT PRESSURE ON, AND FLOW DRILL FLUID, IN A DRILL STRING

(75) Inventors: Tom Kjetil Askeland, Straume (NO); Per Espen Edvardsen, Fyllingsdalen (NO)

(73) Assignee: Siem Wis AS, Knarrevik (NO)

( * ) Notice: Subject to any disclaimer, the term of this patent is extended or adjusted under 35 U.S.C. 154(b) by 379 days.

(21) Appl. No.: 12/665,409

(22) PCT Filed: Jun. 20, 2008

(86) PCT No.: PCT/NO2008/000228

§ 371 (c)(1),
(2), (4) Date: Jun. 7, 2010

(87) PCT Pub. No.: WO2008/156376

PCT Pub. Date: Dec. 24, 2008

(65) Prior Publication Data

US 2010/0236791 A1 Sep. 23, 2010

(30) Foreign Application Priority Data

Jun. 21, 2007 (NO) ..... 20073161

(51) Int. Cl.
*E21B 19/22* (2006.01)
*E21B 19/16* (2006.01)

(52) U.S. Cl. ..... 166/77.51; 166/85.1; 166/88.1

(58) Field of Classification Search ..... 166/77.51, 166/77.1, 88.1, 75.14, 85.1, 378, 382; 175/162, 175/203; 251/1.1; 81/57.16, 57.34
See application file for complete search history.

(56) References Cited

U.S. PATENT DOCUMENTS 3,215,203 A * 11/1965 Sizer ..... 166/77.4
3,474,858 A 10/1969 Gibson et al.
(Continued)

FOREIGN PATENT DOCUMENTS

DE 2643769 A1 3/1978
DE 3339316 A1 5/1985
(Continued)

OTHER PUBLICATIONS

Patent Cooperation Treaty, International Search Report and Written Opinion, International Application No. PCT/NO2008/00125, mailed Aug. 22, 2008.

(Continued)

*Primary Examiner* — Kenneth L Thompson
(74) *Attorney, Agent, or Firm* — Kilpatrick Townsend & Stockton LLP

(57) ABSTRACT

A device is described for maintaining a predominately constant pressure on, and flow of drilling fluid in, a drill string (100) where drilling fluid is supplied via a circulation system for drilling fluid. The device comprises a mainly elongated, internally hollow body (10) arranged to surround the drill string where the hollow body (10) comprises at least an upper pressure chamber (40*a*) and a lower pressure chamber (40*b*) connected with respective inlet and/or outlet (50*a*, 50*b*) for drilling fluid from or to the drilling fluid circulation system, as said pressure chambers (40*a*, 40*b*) are able to be closed and separated by an intermediate valve (70) arranged for circulation of drilling fluid into or out of the drill string (100) during coupling up or disconnecting of a new length of drill string (100). A method to maintain the mainly constant pressure of drilling fluid in a drill string is also described.

10 Claims, 13 Drawing Sheets

U.S. PATENT DOCUMENTS

| | | | | |
|---|---|---|---|---|
| 4,149,603 | A | 4/1979 | Arnold | |
| 4,162,704 | A * | 7/1979 | Gunther | 166/77.53 |
| 4,315,553 | A | 2/1982 | Stallings | |
| 6,119,772 | A | 9/2000 | Pruet | |
| 6,412,554 | B1 * | 7/2002 | Allen et al. | 166/80.1 |
| 6,581,692 | B1 | 6/2003 | Koch et al. | |
| 6,688,394 | B1 * | 2/2004 | Ayling | 166/380 |
| 6,739,397 | B2 * | 5/2004 | Ayling | 166/380 |
| 7,188,683 | B2 * | 3/2007 | Ayling | 175/57 |
| 2003/0221519 | A1 | 12/2003 | Haugen | |

FOREIGN PATENT DOCUMENTS

| | | | |
|---|---|---|---|
| EP | 1 462 687 | A1 | 9/2004 |
| EP | 1 519 003 | A1 | 3/2005 |
| NO | 317 227 | | 9/2004 |
| WO | WO 99/49173 | A1 | 9/1999 |
| WO | WO 2006/010906 | A1 | 2/2006 |
| WO | WO 2007/008085 | A1 | 1/2007 |

OTHER PUBLICATIONS

Patent Cooperation Treaty, International Preliminary Report on Patentability, International Application No. PCT/NO2008/00125, date completed Aug. 19, 2009.

Patent Cooperation Treaty , Written Opinion of the International Preliminary Examining Authority, International Application No. PCT/US2008/000125, mailed Jun. 10, 2009.

Patent Cooperation Treaty, International Search Report, International Application No. PCT/NO2006/00272, mailed Oct. 31, 2006.

Patent Cooperation Treaty, Written Opinion, International Application No. PCT/NO2006/00272, mailed Oct. 31, 2006.

Patent Cooperation Treaty, International Search Report, International Application No. PCT/NO2008/000274, mailed Nov. 4, 2008.

Patent Cooperation Treaty, Written Opinion, International Application No. PCT/NO2008/000274, mailed Nov. 4, 2008.

Patent Cooperation Treaty, International Preliminary Report on Patentability, International Application No. PCT/US2008/000274, dated Aug. 21, 2009.

Patent Cooperation Treaty, International Search Report, International Application No. PCT/NO2008/000228, mailed Aug. 10, 2008.

Patent Cooperation Treaty, Written Opinion, International Application No. PCT/NO2008/000228, mailed Aug. 10, 2008.

Patent Cooperation Treaty, International Preliminary Report on Patentability, International Application No. PCT/NO2008/000228, dated Aug. 9, 2009.

* cited by examiner

DEVICE AND METHOD FOR MAINTAINING CONSTANT PRESSURE ON, AND FLOW DRILL FLUID, IN A DRILL STRING

This application is a national stage application that claims priority under 35 USC §§365 and 371 to PCT/NO2008/000228 filed Jun. 20, 2008, which claims priority to NO 20073161, filed Jun. 21, 2007.

The present invention relates to a device and method for maintaining a mainly constant pressure on, and flow of drilling fluid in, a drill string, where drilling fluid is supplied via a drilling fluid circulation system, as described in the introduction of the respective independent claims.

The drilling industry worldwide experiences many problems during drilling, poor hole stability, formation fracturing and undesirable inflow of formation fluid. When one drills, a drilling fluid (mud) is utilised with a specific gravity which normally lies above the expected pressure from the formation, to hinder inflow of formation fluid, and that a well control situation arises. The pressure of the drilling fluid which acts on the formation must, at the same time, be lower than the pressure which leads to the formation fracturing, something which can lead to the drilling fluid disappearing into the formation and that a well control situation arises. The pressure margin (difference) between inflow of formation fluid and fracturing of the formation can be called a drill window. The pressure on the formation consists of components other than just the weight of the drilling fluid. When one pumps the drilling fluid down and out through the drill string a friction pressure arises in addition, and also that the drilling fluid on the return side contains cuttings normally with a higher density than the drilling fluid. This results in that when one pumps drilling fluid through the drill string the pressure against the formation then increases and when one stops the pressure then drops. The sum of the pressure which the formation is subjected to is called the equivalent circulation density ECD. Changes in ECD usually occur when one stops and starts pumping of drilling sludge through the drill string during coupling or disconnection of a new length of drill string.

The present invention has as an object to ensure a most constant ECD during the drilling operation by enabling the circulation of the drilling fluid even during coupling and disconnection of a new length of drill string. This will lead to a more predictable and stabile ECD, something that again will enable drilling of formations which today are difficult, and to some extent, impossible.

From prior art, amongst others, WO 02/36928 A1 shall be mentioned, which concerns a device and method for maintaining predominantly constant pressure on, and a flow of drilling fluid in, a drill string during coupling and disconnection of a new length of drill string. U.S. Pat. No. 6,315,051 B1 shall also be referred to, which concerns a method for constant circulation during drilling.

The above mentioned objects are achieved with a device which is described herein. According to the invention a device to maintain predominantly constant pressure and flow of drilling fluid in a drill string is provided, where drilling fluid is added via a drilling fluid circulation system, as said device is arranged on a drill floor and comprises: a predominately elongated, internally hollow body arranged to surround the drill string, in which the hollow body comprises, at least, an upper pressure chamber and a lower pressure chamber connected with respective inlets and/or outlets for drilling fluid, from or to the drilling fluid circulation system, as said pressure chambers are able to be closed and separated by an intermediate valve arranged for circulation of drilling fluid into or out of the drill string during coupling or disconnection of a new length of drill string. The upper pressure chamber comprises a seal arranged to surround and seal against the drill string, and a locking anchor for securing the drill string, and the lower pressure chamber comprises a seal arranged to surround and seal against the drill string, and a locking anchor for securing the drill string. The invention is characterised in that an upper part of the elongated body comprises an upper entering cone for receiving the drill string, and that a lower part of the elongated body comprises a landing element with a lower entering cone.

The above mentioned objects are also achieved with a method as described by the following steps: to arrange a predominantly elongated internally hollow body about the drill string, where said body comprises a pressure chamber with an upper and a lower pressure chamber separated by an intermediate valve; to separate the drill string, such that the separated pipe coupling of the drill string is inside the hollow body, and that an upper and lower part of the drill string is locked and sealed in the upper and lower chambers, respectively, at the same time as drilling fluid is added internally in the body such that the drilling fluid with a pressure corresponding to the pressure in the drill string is added in the body: to close between the upper and lower chambers with the help of the intermediate valve such that the pressure is maintained in the lower chamber and to balance the pressure in the upper chamber to that of the surroundings; to release and pull up the upper part of the drill string to collect a new length of drill string with a number of drill pipes; to insert the new length of drill string into the upper chamber, whereupon this is locked and sealed in the upper chamber; to supply drilling fluid into the upper chamber to obtain a corresponding pressure to that of the lower chamber, whereupon the intermediate valve between the upper and the lower chamber is opened; and to connect together the upper and the lower part of the drill string, whereupon the drill string is released and the body is made unpressurised. The method is characterised in that said body is lifted up along the drill string such that the pipe connection is made accessible when there is a need to insert a new length of drill string, and to drive in a roughneck and, at least, partially break up the connection whereupon the roughneck is driven away from the drill string and the body is lowered down over the connection which now has a soft-break status still with drilling fluid under pressure and circulation inside.

DETAILED DESCRIPTION

Figure 1:
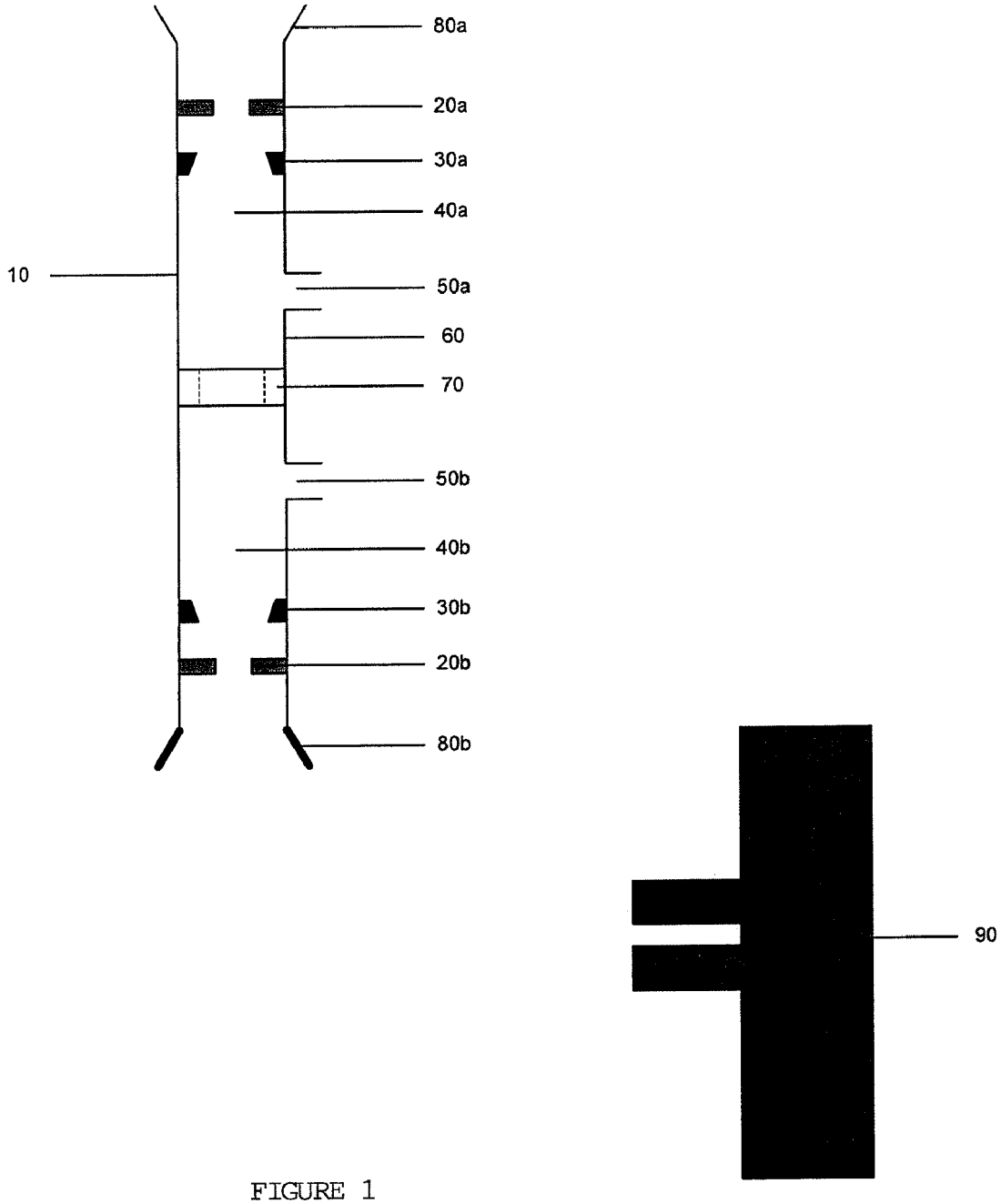
FIG. 1 is a schematic view of an illustrative embodiment of a device for maintaining constant pressure on, and flow drill fluid, in a drill string.
Figure 2:
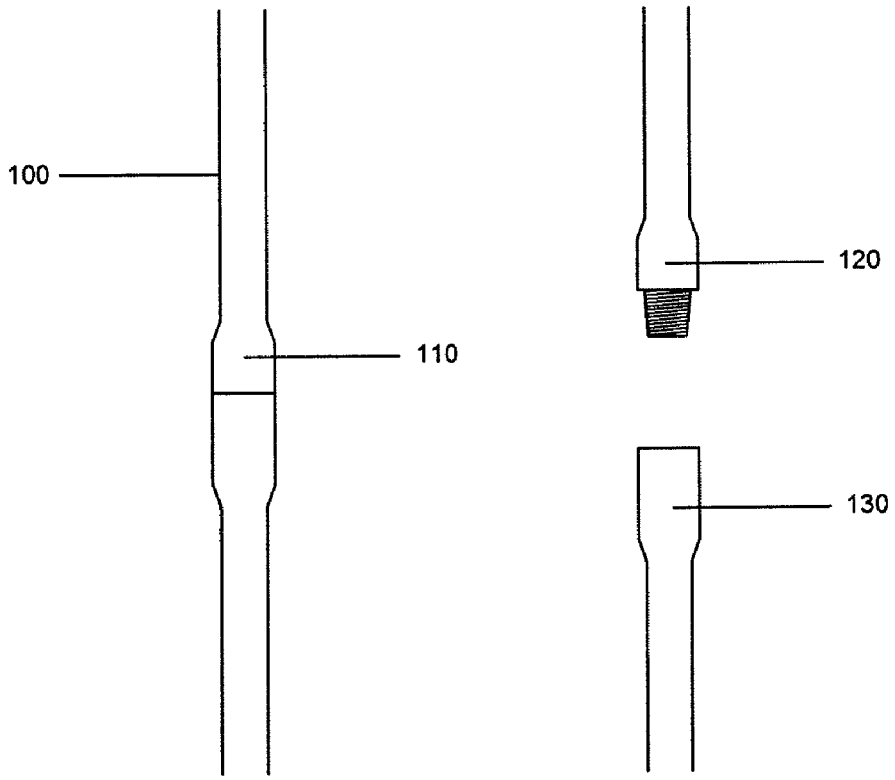
FIG. 2 is a schematic view of an illustrative embodiment of a drill string.

The invention comprises, as shown, a common pressure container 60 in which several components are localised. The components can be threaded, flanged or machined such that they can be put together to create a common pressure container function 60.

An entering cone 80*a* can be found uppermost. The function of the entering cone 80*a* is to guide the drill string into the invention. An upper seal 20*a* can be found below the entering cone 80*a*. The seal has a composition which enables it to make a seal around a chosen drill string 100 including the variable diameter which the drill string represents. The seal allows for movement by the drill string 100 both axially and rotationally, at the same time as it seals against the working pressure which is defined in advance.

An upper locking anchor 30*a* is arranged below the upper seal 20*a*. The locking anchor is arranged so that when it is not connected up (deactivated), it allows a drill string 100 to freely move through. When the locking anchor is connected up (activated) the bottom of the drill string (the pin end) 120 is hindered from passing because of the increased diameter of the pipe connection 110. The locking anchor is qualified to withstand the forces of separation that can arise in the pressure container during normal operation.

An upper pressure chamber 40*a* is placed between the upper locking anchor 30*a* and an intermediate valve 70 in the body 10. An inlet 50*a* for injection or return of drilling fluid is arranged in the side of the upper pressure chamber. When the valve is open the upper pressure chamber 40*a* is in direct hydraulic connection with the lower pressure chamber 40*b*.

The valve 70 is arranged between the upper 40*a* and the lower 40*b* pressure chamber. The make-up of the valve is such that when it is open it allows the drill string 100, including the pipe connection 110, to freely pass through. When it is closed, the valve is qualified to withstand the working pressure that has been defined in advance and thus to isolate the upper 40*a* and the lower 40*b* pressure chambers both hydraulically and mechanically.

A lower pressure chamber 40*b* is situated between the valve 70 and the lower locking anchor 30*b*. An inlet 50*b* for injection or return of drilling fluid is arranged at the side of the lower pressure chamber. When the valve is open the upper pressure chamber 40*a* is in direct hydraulic connection with the lower pressure chamber 40*b*.

A lower locking anchor 30*b* is situated below the lower pressure chamber 40*b*. The locking anchor is arranged so that when it is not connected up (deactivated) it allows a drill string 100 to freely move through. When the locking anchor is connected up (activated) the top (box end) 130 of the drill string is hindered from passing through because of the increased diameter of the pipe coupling 110. The locking anchor is qualified to withstand the forces of separation that can arise in the pressure container during normal operation.

A lower seal 20*b* is situated below the lower locking anchor 30*b*. The composition of the seal is such that it is able to seal around a chosen drill string 100 including the variable diameter which the drill string represents. The seal permits movement of the drill string both axially and rotationally, at the same time as it seals against the working pressure which has been defined in advance.

A landing element with an entering cone 80 is at the bottom of the invention. The landing element is arranged so that it can take up the forces that can arise when one puts the weight of the present device with a drill string that runs through down onto the drill floor. In addition the entering cone contributes to ensure that the couplings on the drill string are led into the invention.

The present device can be arranged on drill floors both ashore on floating rigs or platforms. The invention will represent an additional function to the standard functions on a drill floor. In addition it is dependent on established and adjoining systems functioning normally. Typical systems are, for example; iron roughnecks, tongs, mud systems, topdrive systems, handling systems and the like. These are well known by a person skilled in the arts and will not be explained in more detail.

The device will normally be dependent on its own systems for control, monitoring and operation. These will not be described in this application.

The seals that are used in the device can be of different shape, principles of operation and embodiment. There are different systems for sealing around drill strings on the market today, and also some are under development. Some seals are arranged in a ball/gliding bearing solution such that the whole of the seal rotates with the drill string whilst other seals have a fixed securing mechanism where the seal is held static even if the drill string rotates. There are also variations where several sealing elements are put together to achieve a common sealing function. In addition there are sealing solutions with injection of friction reducing liquid over or directly into the sealing surface and/or between the seals. Some seal solutions are based on the principle of forming a pressure gradient over a set of seals. There are also seals that can be opened and closed against the drill string (annular preventer, pipe ram). All these different seals or combinations of these are described with the common denotation of seal in this application.

Bore pipes are used as a common denotation for all types of bore pipes that are used within drilling in oil wells, water wells and gas carrying wells. This includes so-called snubbing operations. The bore pipes can be standard or custom made, with or without special lubrication for threads or seals (o-rings, etc.).

Description of Method in Use.

Figure 3:
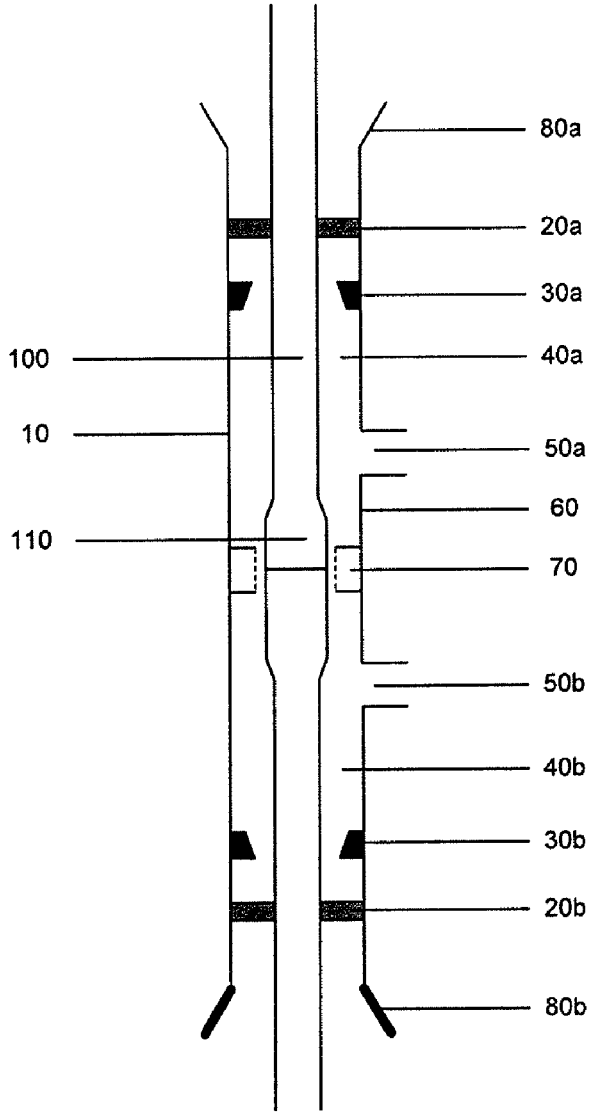
FIG. 3 is a schematic view of an illustrative embodiment of a device in a first configuration.

FIG. 3 shows the device after it has been fitted around the drill string 100. Then the seals 20*a*, 20*b* lie against the drill string without being exposed to pressure, something which results in limited wear on the seals. The valve 70 and the locking anchors 30*a*, 30*b* are in open position such that the drill string can freely pass through the body 10. The drill personnel can carry out drilling operations as normal without taking special care for the invention. During drilling, the drilling fluid is pumped through the drill string.

Figure 4:
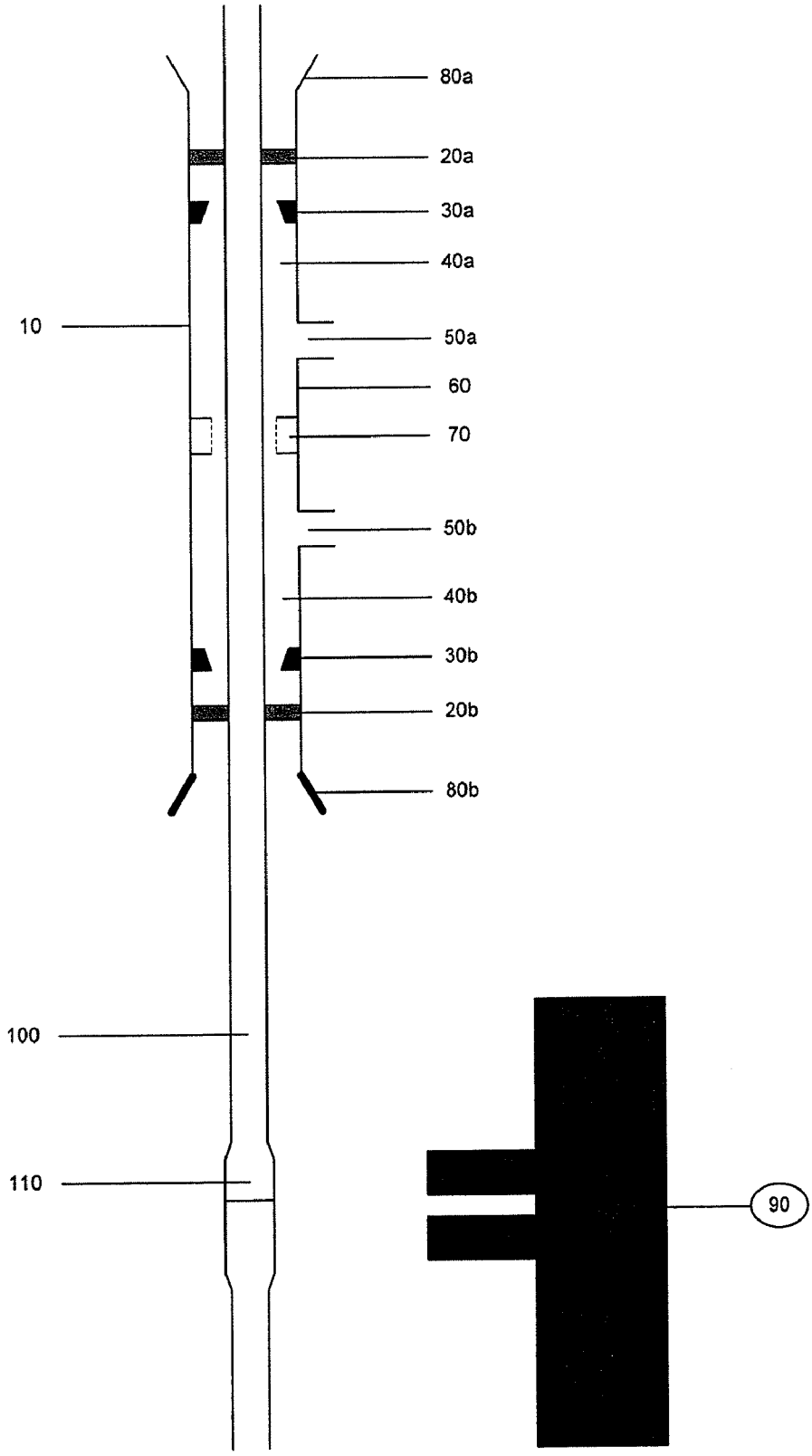
FIG. 4 is a schematic view of an illustrative embodiment of a device in a second configuration.

FIG. 4 shows that the body 10 is lifted up along the drill pipe so that the pipe coupling 110 becomes accessible. This occurs when one has drilled so far down that there is a need to insert a new length of drill pipe. A roughneck 90 can then be driven in and break up the coupling 110. The breaking up shall initially only be carried out with a power/movement that leads to the coupling maintaining its ability to retain pressure at the same time as the power which is later required to open the coupling can be supplied from the topdrive of the rig. This method to break a coupling is called soft-break.

When the roughneck 90 has carried out a soft-break it is driven away from the drill string. The body 10 can now be lowered down over the coupling which now has a soft-break status, still with drilling fluid under pressure and circulating inside.

Figure 5:
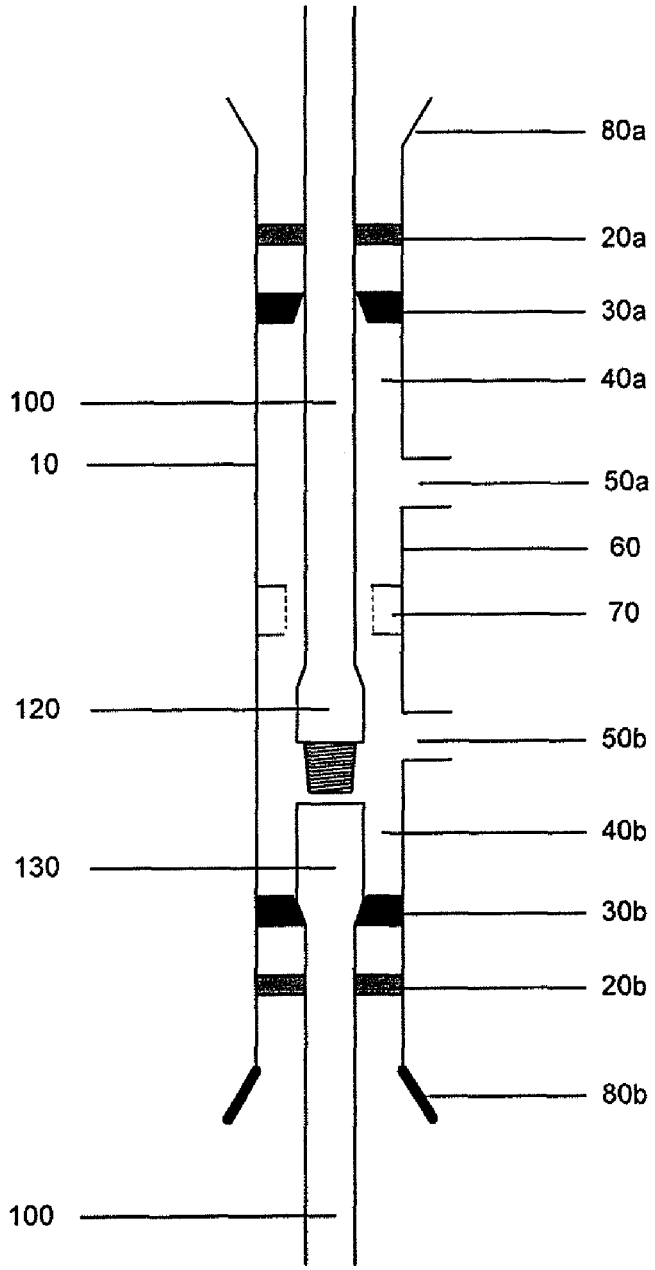
FIG. 5 is a schematic view of an illustrative embodiment of a device in a third configuration.

FIG. 5 shows that the body is localised over the pipe coupling 110, the locking anchors 30*a*, 30*b* are activated and the seals 20*a*, 20*b* are functioning. The coupling 110 on the drill pipe is now opened up with the help of the topdrive and the parts 120, 130 are separated from each other. The drilling fluid still circulates through the drill string 100 via the pressure chamber 60. In this phase a pressure from the drilling fluid is established at the same time in the lower inlet of drilling fluid 50*b*. The pressure is identical with the pressure in the drill string. The upper inlet for drilling fluid 50*a* is closed during this operation.

Figure 6:
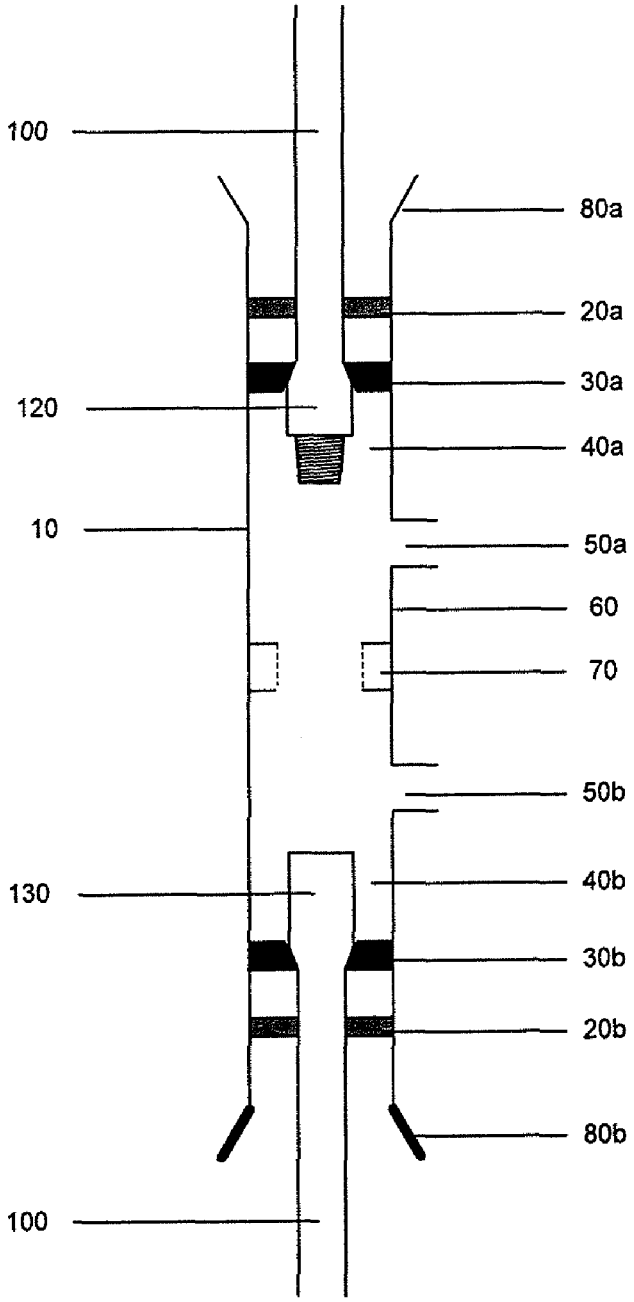
FIG. 6 is a schematic view of an illustrative embodiment of a device in a fourth configuration.

FIG. 6 shows that the upper end 120 of the drill string is pulled up over the valve 70 and is placed against the upper locking anchor 30*a*. Pumping of drilling fluid is thereafter gradually transferred from the drill string to the lower inlet 50*b* for drilling fluid until it is only pumped in via the lower inlet 50*b*. The formation has so far not been able to register any pressure variation in the drilling fluid.

Figure 7:
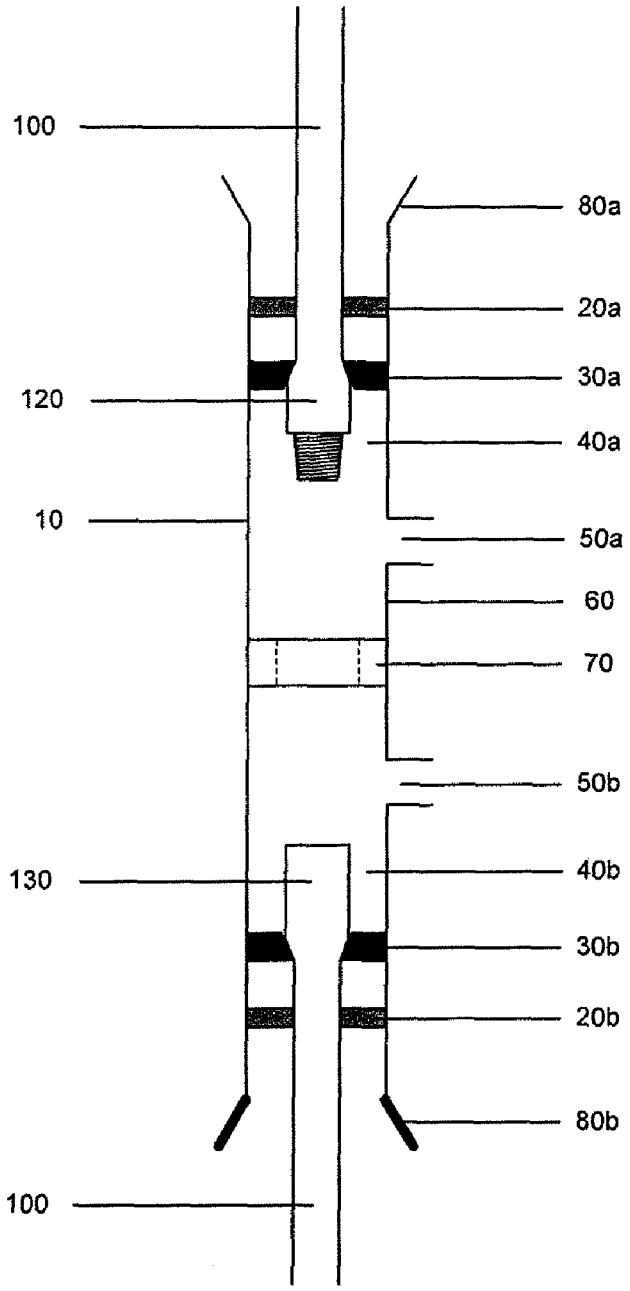
FIG. 7 is a schematic view of an illustrative embodiment of a device in a fifth configuration.

FIG. 7 shows that after all injection of drilling fluid is transferred to the lower inlet 50*b* and no drilling fluid is pumped through the part 120 of the drill string, which is situated in the upper locking anchor 30*a*, the valve 70 can close. The two pressure chambers 40*a*, 40*b* are now hydraulically and mechanically separated. The pressure and the fluid that are in the upper pressure chamber and the drill string can now be bled off and be emptied out via the upper outlet 50*a*.

Figure 8:
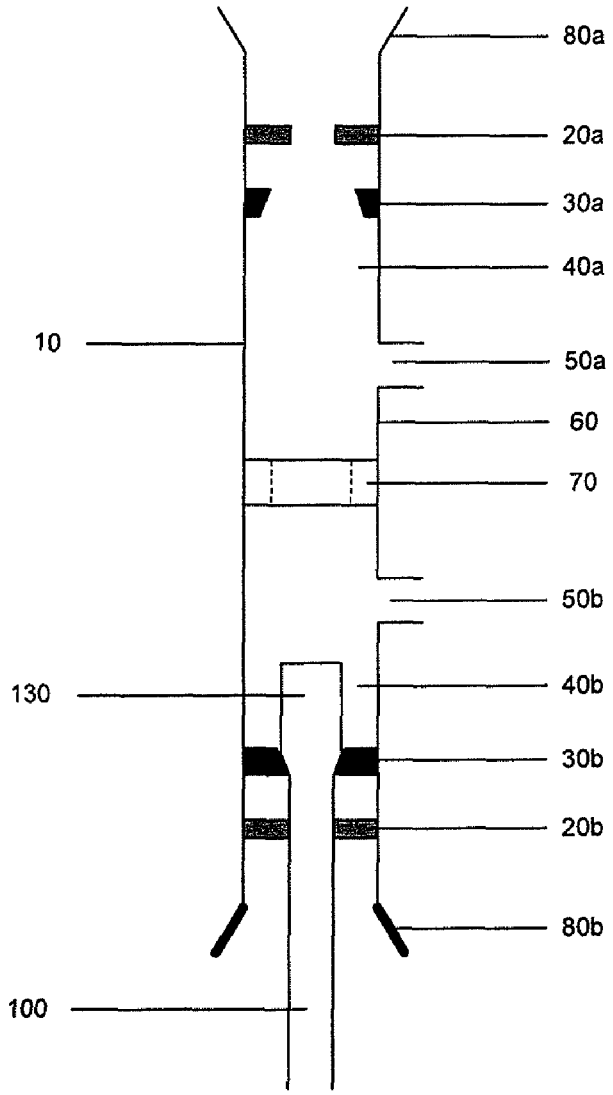
FIG. 8 is a schematic view of an illustrative embodiment of a device in a sixth configuration.

FIG. 8 shows that after the upper pressure chamber 40*a* and the drill stem have become unpressurised, the upper locking anchor 30*a* can be opened and the drill string is pulled out to collect a new length of drill pipe. Circulation to the part 30 of the drill string which is in the well now takes place completely via injection in the lower inlet 50*b*.

Figure 9:
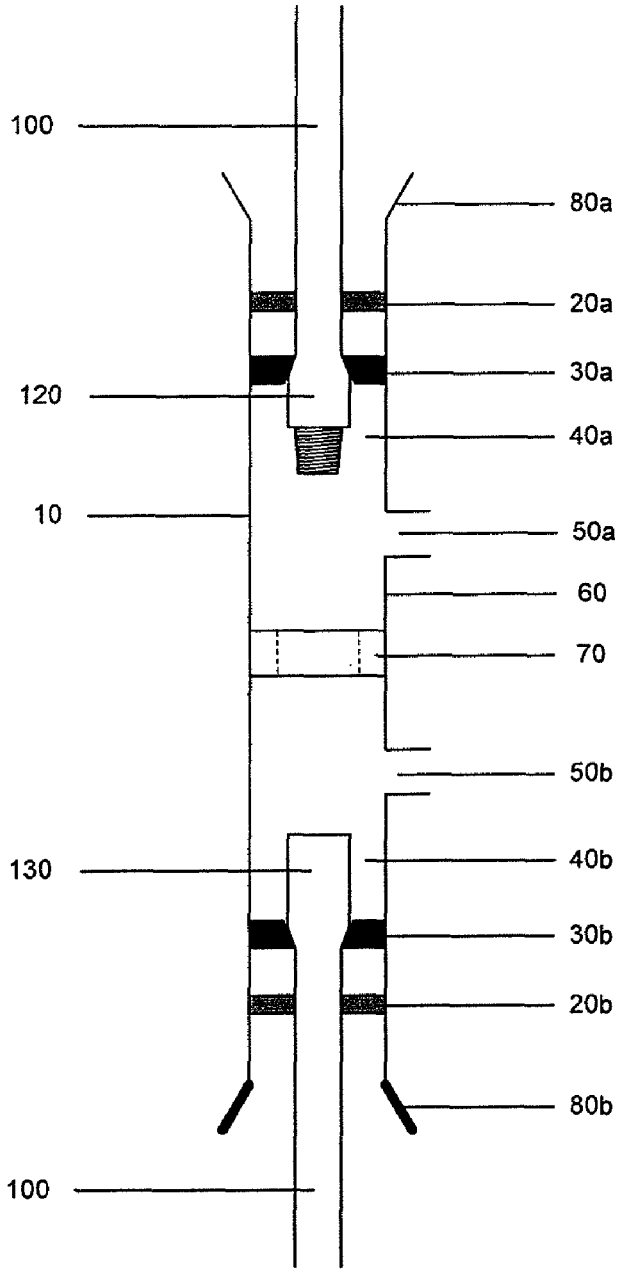
FIG. 9 is a schematic view of an illustrative embodiment of a device in a seventh configuration.

FIG. 9 shows that when the new drill string is collected, it is led into the body 10 from the top and down through the upper seal 20*a* and the upper locking anchor 30*a* which is then closed (activated). Thereafter the new drill string and the upper pressure chamber 40*a* is filled with drilling fluid and pressurised to the same pressure as the pressure of the drilling fluid in the lower pressure chamber 40*b*. The pressure is then equalised across the valve 70.

Figure 10:
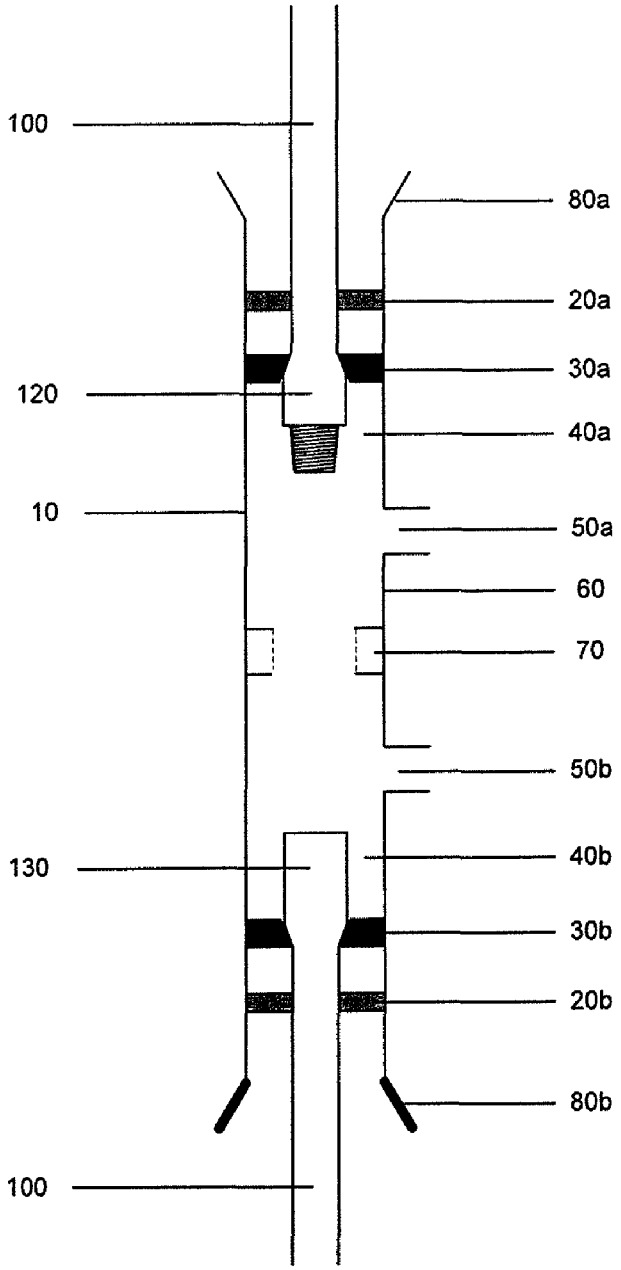
FIG. 10 is a schematic view of an illustrative embodiment of a device in an eighth configuration.

FIG. 10 shows that when the pressure is equalised across the valve 70, this can be opened. Circulation of drilling fluid now takes place in parallel both via the drill string and via the lower inlet 50*b*.

Figure 11:
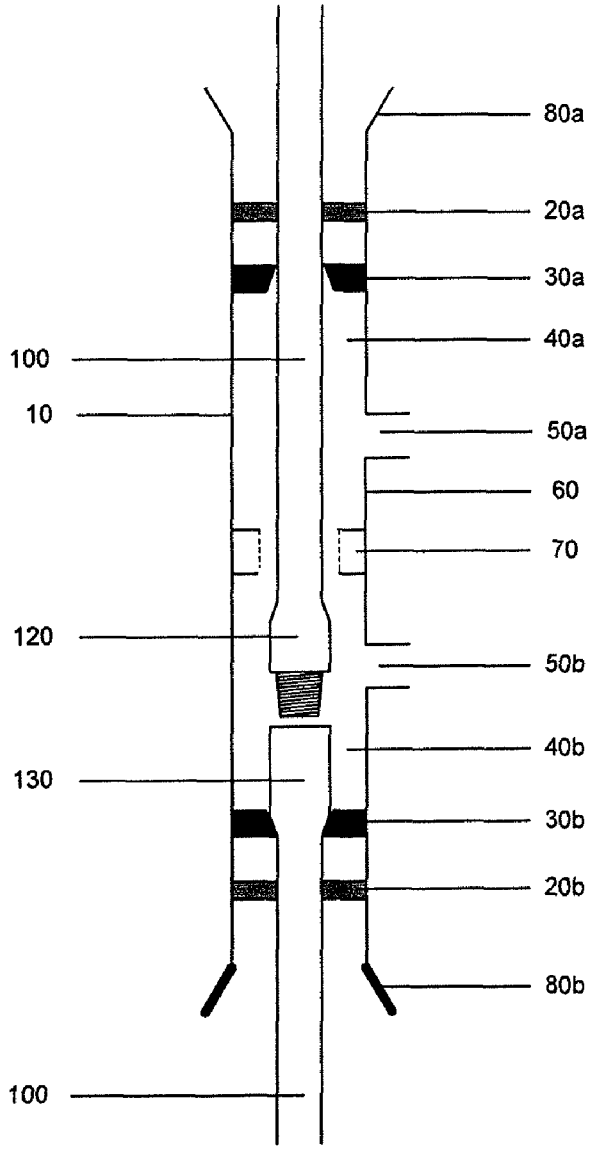
FIG. 11 is a schematic view of an illustrative embodiment of a device in a ninth configuration.

FIG. 11 shows that the upper part 120 of the drill string is led down toward the lower part 130. The circulation via the lower inlet 50*b* is gradually stopped until all circulation takes place via the upper part 120 of the drill string.

Figure 12:
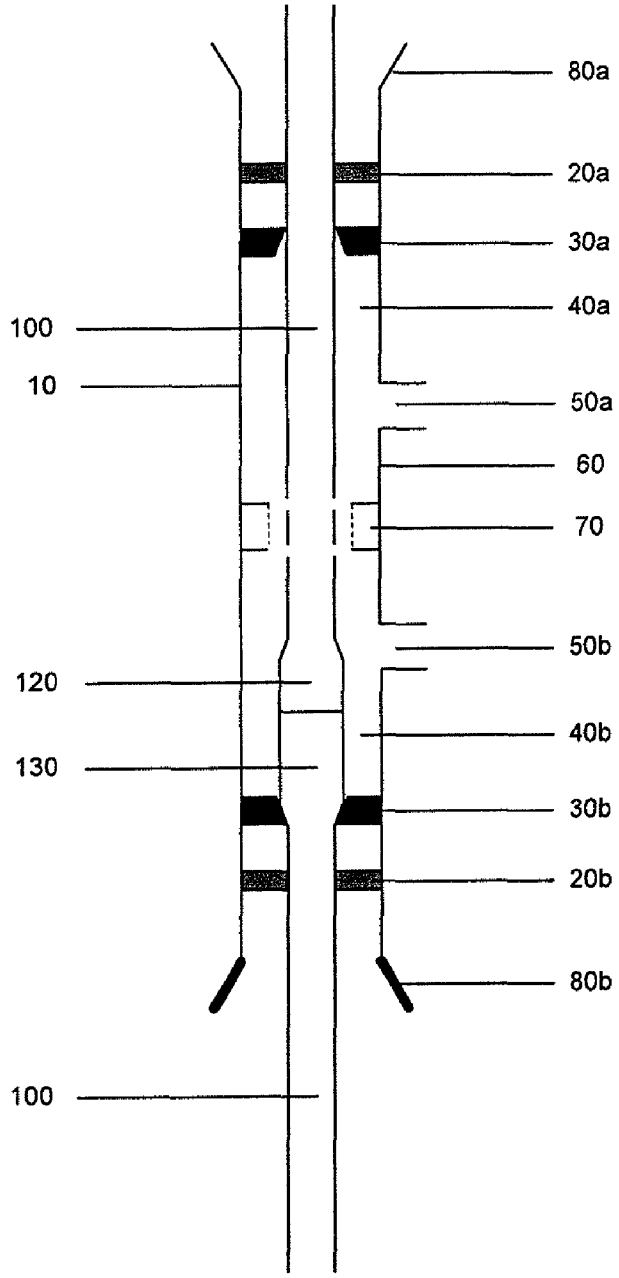
FIG. 12 is a schematic view of an illustrative embodiment of a device in a tenth configuration.

FIG. 12 shows that the drill string 100 is coupled together in that the topdrive (not shown) spins the upper part 120 of the drill string into the lower part 130. The coupling is made so that it withstands the pressure that is on the inside without leaking (soft make up). After this has been carried out the pressure chambers 40*a*, 40*b* are de-pressurised and the device appears without pressure against the seals 20*a*, 20*b*.

Figure 13:
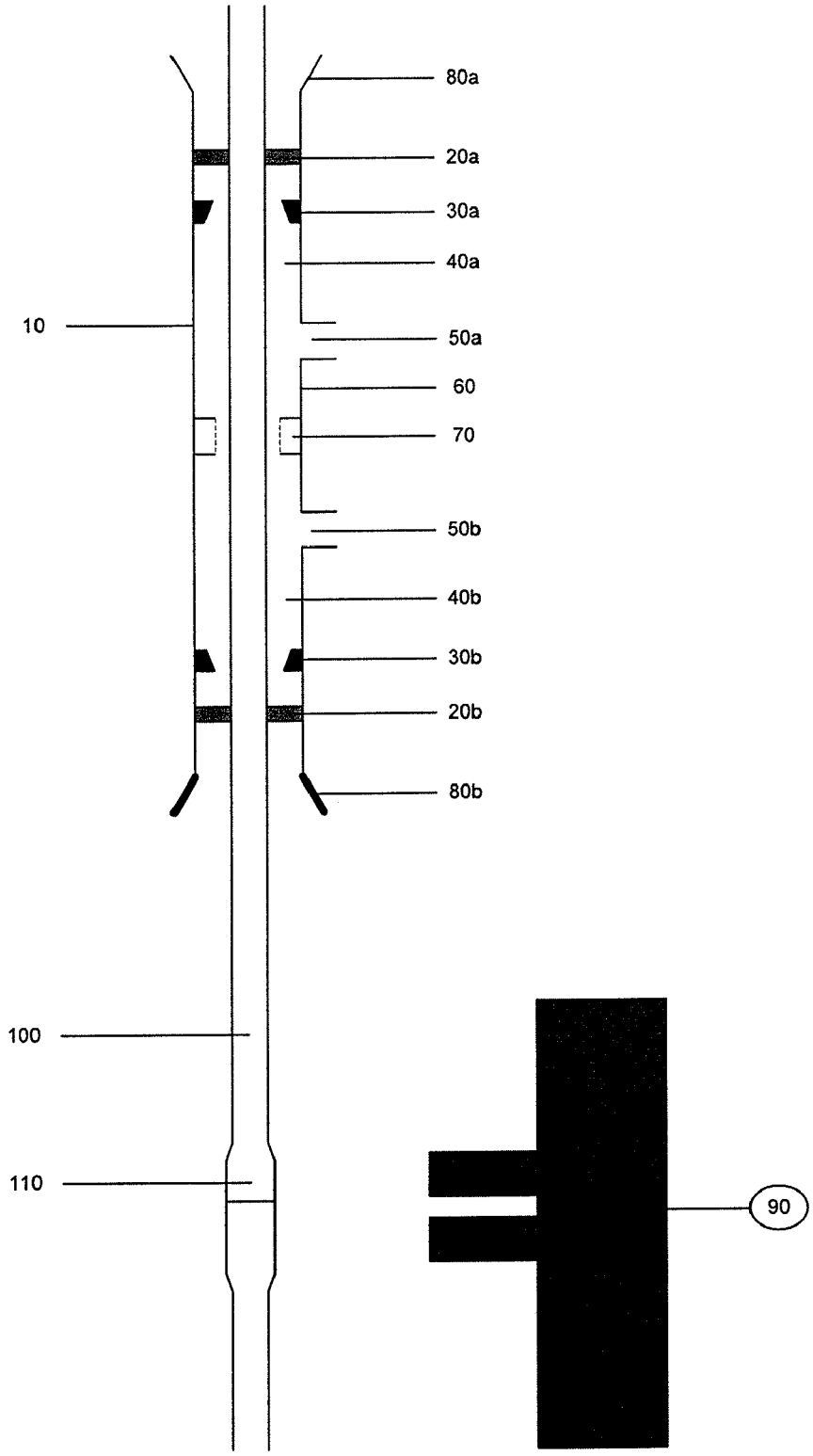
FIG. 13 is a schematic view of an illustrative embodiment of a device in an eleventh configuration.

FIG. 13 shows that after the invention has been made un-pressurised, it is lifted up along the drill string 100 to make room for the iron roughneck 90. This is brought forward and applies a predetermined connecting force (moment). The drilling can now continue as normal until the next coupling shall be carried out.

At pulling/removal of drill pipes, the sequence is repeated in the opposite order.

The invention claimed is:

1. Method to maintain a predominately constant pressure on, and flow of drilling fluid in, a drill string during drilling, where drilling fluid is supplied via a circulation system for drilling fluid, comprising the following steps:

arranging a mainly elongated, internally hollow body around the drill string where said body comprises a pressure chamber with an upper and a lower pressure chamber separated by an intermediate valve, separating the drill string so that the pipe coupling, which is separated from the drill string, is inside the elongated, internally hollow body and that an upper and a lower part of the drill string is locked and sealed in the respective upper and lower chambers at the same time as drilling fluid is supplied to the inside of the body such that drilling fluid at a pressure corresponding to the pressure in the drill string is supplied to the body, closing between the upper and the lower pressure chambers by the intermediate valve so that the pressure is maintained in the lower chamber and to equalize the pressure in the upper chamber to the surroundings, releasing and pulling up the upper part of the drill string to collect a new length of drill string with a number of drill pipes, leading the new length of drill string into the upper chamber whereupon it is locked and sealed in the upper chamber, supplying drilling fluid to the upper chamber to obtain a pressure corresponding to the pressure in the lower chamber, whereupon the intermediate valve between the upper and the lower chambers is opened, and coupling together the upper and the lower part of the drill string whereupon the drill string is released and the pressure is released in the body, wherein said body is lifted up along the drill string so that the pipe coupling is made accessible when there is a need to insert a new length of drill string, and to drive in a roughneck and, at least, break up the coupling, whereupon the roughneck is driven away from the drill string and the body is lowered down over the coupling which now has a soft-break status still with drilling fluid under pressure and circulating inside.

2. Method according to claim 1, wherein the locking anchors are activated and the seals are functioning and that the coupling on the drill string is opened up with the help of a topdrive and the pipe parts are separated from each other at the same time as drilling fluid circulates through the drill string via said pressure chamber, whereupon a pressure of drilling fluid is arranged in the lower inlet for drilling fluid where the pressure corresponds to the pressure in the drill string.

3. Method according to claim 2, wherein the upper end of the drill string is pulled up above the intermediate valve and is placed against the upper locking anchor and that pumping of drilling fluid is gradually transferred from the drill string to the lower inlet for drilling fluid until the drilling fluid is only pumped in via the lower inlet.

4. Method according to claim 3, wherein after all injection of drilling fluid is transferred to the lower inlet, and no drilling fluid is pumped through the drill string that is situated in the upper locking anchor, the lower valve is closed, so that the two pressure chambers are hydraulically and mechanically separated, whereupon the pressure and the drilling fluid which are in the upper chamber and the drill string is bled off and emptied out via the upper outlet.

5. Method according to claim 4, wherein after pressure has been released in the upper chamber and the drill string, the upper locking anchor is opened and the drill string is pulled out to collect a new length of drill pipe and that the circulation in the drill string which is in the well takes place via injection into the lower inlet.

6. Method according to claim 5, wherein when the new part of the drill string is collected, it is led into the body through the top and down through the upper seal and the upper locking anchor, which is then closed, thereafter the new part of the drill string and the upper chamber are filled with drilling fluid and pressurized to the same pressure as the pressure of the drilling fluid in the lower chamber so that the pressure is equalized across the valve.

7. Method according to claim 6, wherein when the pressure is equalized across the valve, it is opened and that circulation of drilling fluid is carried out in parallel via the drill string and via the lower inlet.

8. Method according to claim 7, wherein the circulation via the lower inlet is gradually stopped until all circulation comes via the upper part of the drill string and that the upper part of the drill string is led down towards the lower part of the drill string.

9. Method according to claim 8, wherein the drill string is coupled together in that the topdrive spins the upper part of the drill string into the lower part, and that the coupling is made up so that it retains the pressure which exists on the inside without leaking whereupon the pressure chambers are depressurized.

10. Method according to claim 9, wherein after pressure in the body is released, the body is lifted up along the drill string to make room for the iron roughneck which is driven forward and provides a connecting force which has been defined in advance.

* * * * *